United States Patent [19]

Bendler et al.

[11] 4,043,128

[45] Aug. 23, 1977

[54] COMPRESSED-GAS CARTRIDGE FOR FIRE PROTECTION PURPOSES

[75] Inventors: Hellmut Bendler, Stein; Anton Bretfeld, Nurnberg, both of Germany

[73] Assignee: Dynamit Nobel Aktiengesellschaft, Germany

[21] Appl. No.: 662,290

[22] Filed: Feb. 27, 1976

[30] Foreign Application Priority Data

Mar. 5, 1975 Germany ..... 2509496

[51] Int. Cl.[2] ..... F01B 29/08; F24F 7/02; L05F 15/20; F02N 13/00

[52] U.S. Cl. ..... 60/636; 60/632; 49/7; 98/86; 137/68 A; 169/54

[58] Field of Search ..... 60/636, 637, 632; 169/56 -61, 42, 54; 137/68 A, 68 R; 98/86, 29; 52/1; 49/7

[56] References Cited

U.S. PATENT DOCUMENTS

| | | | |
|---|---|---|---|
| 1,914,250 | 6/1933 | Gillen | 60/632 X |
| 2,783,845 | 3/1957 | Mathisen | 169/54 X |
| 3,182,581 | 5/1965 | Von Poederoyen et al. | 98/86 |
| 3,516,197 | 6/1970 | Lyons | 98/86 X |
| 3,516,198 | 6/1970 | Lyons | 49/1 |
| 3,601,437 | 8/1971 | Lyons | 49/7 X |
| 3,738,253 | 6/1973 | Jentoft | 98/86 |

FOREIGN PATENT DOCUMENTS

| | | | |
|---|---|---|---|
| 2,246,791 | 5/1975 | France | 137/68 A |
| 2,146,839 | 9/1971 | Germany | 169/58 |
| 392,927 | 1931 | United Kingdom | 169/60 |

*Primary Examiner*—Wendell E. Burns
*Attorney, Agent, or Firm*—Craig & Antonelli

[57] ABSTRACT

Apparatus for fire protection purposes including a compressed-gas cartridge device with at least a thermally responsive triggering mechanism. The triggering mechanism includes a striker for forcibly being driven toward the compressed-gas cartridge device and a locking device for maintaining the striker at a spacing from said compressed-gas cartridge device by engaging a portion of said striker pin with one end portion thereof. Another end portion of the locking device is biased against a blocking device with the blocking device being disposed between the another end portion of the locking device and an abutment member. The blocking device is responsive to the exceeding of a predetermined temperature for enabling displacement of the locking device out of engagement with the striker thereby permitting movement of the striker toward the compressed-gas cartridge device.

29 Claims, 2 Drawing Figures

COMPRESSED-GAS CARTRIDGE FOR FIRE PROTECTION PURPOSES

Figure 1:
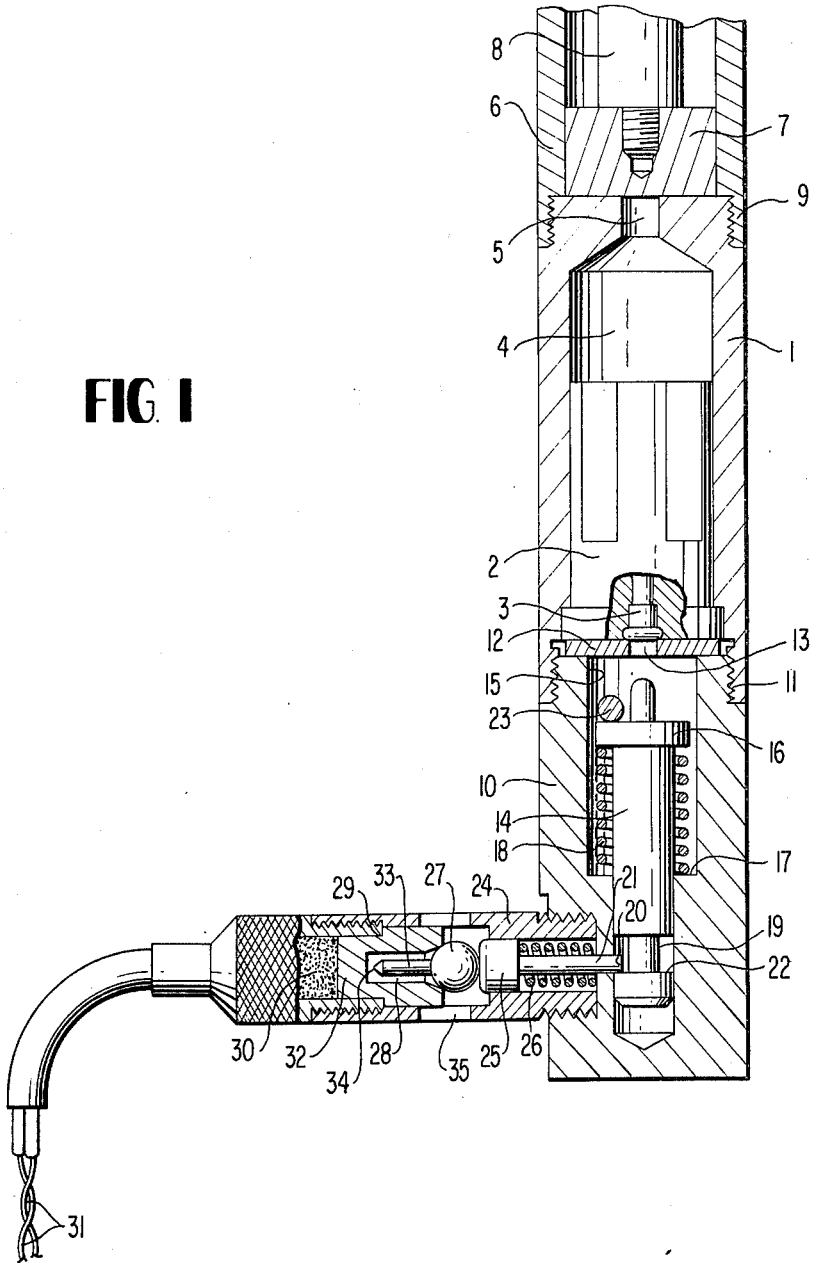

The present invention relates to a compressed-gas cartridge for fire protection purposes with a thermal triggering mechanism, preferably for the opening of smoke exhaust devices.

In order to open smoke exhaust flaps, skylights, or the like, preferably in roofs of large halls or auditoriums, devices have been known wherein a piston is pneumatically displaced within a servo cylinder, the piston rod of which is directly effective on the flap, door, window, or the like to be opened. The compressed air for actuating the piston is stored in a pressure bottle which is opened in case of emergency mechanically or pyrotechnically. It is also possible to connect these devices with smoke- or temperature-sensitive sensors and to trigger the opening operation automatically. Thus, small glass vessels or glass ampoules are used, which are filled with alcohol or a similar fluid and burst by expansion of the fluid when a predetermined temperature of, for example, 60°, 70°, or 80° C. has been exceeded. These are, for example, so-called "ESTI" cartridges. The bursting of the vessels then causes the closing of an electric circuit via an electric switch, and this circuit, in turn, effects the opening of the pressure bottle valve. These automatically actuatable devices, however, are relatively expensive due to the electric circuit, electrically activated valve, the energy supply, etc. Also, the flawless functioning of the electrical parts of the mechanism cannot be readily checked at intervals, since the circuit is interrupted by the interposed glass ampoules.

The present invention has as an object the avoiding of the aforementioned disadvantages and the fashioning of a compressed-gas cartridge for fire protection purposes so that it is of a maximally simple construction, requires a minimum effort in assembly and operation, and furthermore is maximally insensitive to disturbances caused by the surroundings.

In accordance with the invention, there is provided a compressed-gas cartridge for fire protection purposes with a thermal triggering mechanism wherein the compressed-gas cartridge can basically be constructed as a compressed-gas bottle, filled, for example, with compressed air. The opening of this bottle is caused directly by a striker pin which penetrates, for example, a sealing diaphragm of a metal. Preferably, however, the compressed-gas cartridge is fashioned as a compressed-gas generator wherein the compressed gas is produced only in the case of emergency, so that the compressed-gas cartridge is initially, i.e. in the rest condition, not under pressure, and leakage losses during the rest condition are avoided. Such a compressed-gas generator has been described, for example, in DOS (German Unexamined Laid-Open Application) No. 1,771,644, wherein a solid propellant is ignited when required by means of a primer element mechanically triggered by the striker pin, thus producing the compressed gas. The form-fitting engagement of one end of the locking element in the striker pin during the rest condition can be accomplished, for example, by providing that the pin-shaped locking element extends into a transverse bore of the striker pin. Preferably, the striker pin, however, is equipped for this purpose with an annular groove into which the locking element extends with one end thereof, so that the striker pin rests under the bias of the tensioned spring against the locking element with the groove flank facing away from this spring. The locking element is guided in a housing so that it can flawlessly absorb the transverse force exerted thereon by the striker pin during this operation. In general, the locking element is arranged with its longitudinal axis perpendicularly to that of the striker pin, but it can also be disposed at an angle with respect to the striker pin deviating from 90°. In such case, the displacement path of the locking element must, however, always be dismensioned so that it releases the striker pin during its lateral movement away from the latter, i.e. so that it comes out of engagement with the striker pin.

The locking element, in the rest condition, is supported at the abutment by way of the blocking element which is constructed as a temperature-sensitive sensor. For this purpose, the blocking element can be formed, for example, as a rod-shaped element of defined dimensions, made of a metal and/or a corresponding metal alloy which melts when a predetermined temperature has been reached, for example Wood's alloy. The temperature-dependent triggering of the compressed-gas cartridge of the present invention is then accomplished by the fact that the blocking element is partially or completely melted when the limit temperature has been exceeded, thereby changing its shape under the spring force of the locking element in such a way, or is thereby removed from its blocking position so that the locking element can move away laterally from the striker pin under the force of the biased spring associated with the locking element, such that the striker pin is released.

The compressed-gas cartridge of the present invention with the integrated thermal sensor represents a compact structural element which is of a simple structure, is insensitive, and is automatically operable, i.e. requires no additional accessories to effect, for example, the opening of smoke exhaust devices, the activation of extinguishing mechanisms, or the triggering of other temperature dependent operations.

In order to be able to also obtain, by means of the compressed-gas cartridge of the invention, an intended triggering at ambient temperatures below the predetermined limit temperatures, a further embodiment of the invention provides that the abutment of the blocking element is not constructed as a fixed member, but rather moveable as a piston displaceable under the pressure action of an electrically actuatable primer. This piston, during its displacement, likewise changes the shape of the blocking member and/or, for example, destroys this blocking member and thereby removes it out of the blocking position, so that the locking element can laterally move away from the striker pin to such an extent that the striker pin is released. This provides the possibility, for example, to intentionally trigger during a fire in the lower floors of a high rise the smoke exhaust devices located in the upper floors or in the roof, completely independently of the temperature ambient at those locations, by means of an electrical remote control arrangement. This additional selective electrical triggering can be attained with little expenditure and is advantageously combined with the thermal sensor in one component of small size. For the triggering operation, only a comparatively small amount of electrical energy is required, inasmuch as only the electrical primer element needs to be actuated, rather than an electric valve or the like of the compressed-gas cartridge. Additionally, the functional readiness of the electric triggering system can be controlled without difficulties, since there are no contacts in the circuit which are closed only by the actual triggering step.

Checking can be executed in a simple manner by determining the electric resistance of the circuit, wherein the amperage of the measuring or closed-circuit current is to be selected to be so low that the electric primer elements are not initiated with certainty.

In order that the piston, in the rest condition, can serve as a solid abutment for the blocking element, it is possible to maintain the piston within the housing by way of radial shear pins or the like which are severed only after triggering of the primer element. However, it is more advantageous to provide the piston with an annular shoulder at its outer surface by means of which the piston is supported on a corresponding counter surface of the housing in the direction toward the primer charge.

A particularly favorable construction of the blocking element is accordance with the present invention is that of a glass ampoule or vessel filled with a fluid which destroys the ampoule when a predetermined temperature is exceeded. These conventional glass ampoules commercially obtainable, for example, under the name of "ESTI" cartridge, can be manufactured at low expense and react relatively quickly also in cases where the limit temperature is exceeded only by a small amount. In this connection, the constructional design of the housing receiving such ampoules must be such that the glass slivers produced during the triggering thereof do not unduly impede the lateral displacement of the locking element.

The compressed-gas cartridge of the present invention is intended particularly for the opening of smoke exhaust devices. An advantageous connection of the servo cylinders known for this purpose with the piston and piston rod, effective directly on the skylight, flap, or the like to be opened is provided in that the compressed-gas cartridge is disposed in the axial extension of the servo cylinder and is in communication with the piston chamber thereof via a reducing bore.

Figure 2:
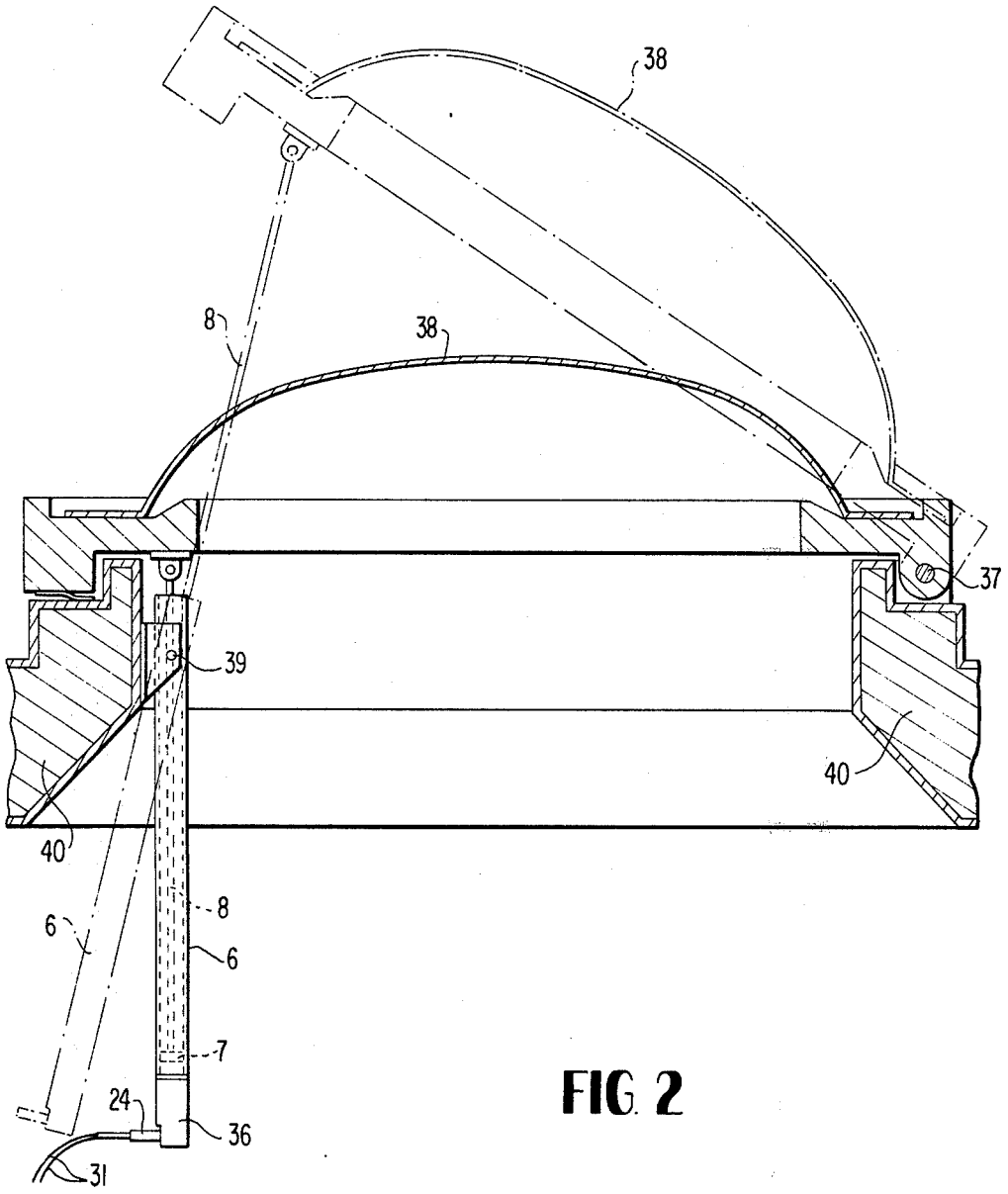

These and other objects, features and advantages of the present invention will become more apparent from the following description when taken in connection with the accompanying drawings, which show, for purposes of illustration only, one embodiment in accordance with the present invention, and wherein:

FIG. 1 illustrates the compressed-gas cartridge with the triggering device in accordance with the present invention in a longitudinal sectional view; and FIG. 2 illustrates the attachment of a compressed-gas cartridge system of the present invention to a skylight.

Referring now to the drawings, there is shown in FIG. 1, a compressed-gas cartridge 2, in an elevational view, inserted in a cylindrical metal cartridge case 1 of, for example, steel, brass, or aluminum, with the pyrotechnical mixture of this cartridge being ignited by a percussion-sensitive primer element 3. The cartridge is provided with a free forward volume area 4, amounting preferably to 20–50% of the cartridge volume which is disposed at the front of the compressed-gas cartridge. This volume area 4 is in communication via a reducing bore 5 with a servo cylinder 6 made, for example, of steel, and/or with the space underneath a piston 7 having a piston rod 8, both, for example, being made of aluminum. By selecting the inside cross section of the reducing bore 5, the piston speed during extension can be regulated such that the narrower the bore cross section, the lower the speed. The cartridge case 1 is arranged in the axial extension of the servo cylinder 6 and connected in a gastight manner with the latter, for example, via a threaded connection 9. The piston 7 can optionally be furthermore provided with at least one annular sealing element, now shown, contacting the inner wall of the servo cylinder 6.

At the rear end, the cartridge case 1 is connected to a striker pin housing 10, preferably by way of a screw thread 11, wherein a retaining disk 12 with a central opening 13 is clamped between the two components. The disk 12 retains, on the one hand, the primer element 3 in the recess of the compressed-gas cartridge 2 and, on the other hand, limits the axial path of the striker pin 14, shown in an elevational view. The striker pin housing 10 of preferably metal, e.g. steel, brass, or aluminum, furthermore seals the compressed-gas cartridge 2 toward the rear by means of the retaining disk 12. The striker pin 14 is guided within the cylindrical striker pin housing 10 in a recess 15 extending in the longitudinal direction of the housing. A tensioned spring 18 is disposed between a flange 16 of the striker pin and an annular shoulder 17 of the recess 15. At the rear end, the striker pin 14 has an annular groove 19 form-fittingly engaged by one end 20 of a locking element 21, shown in an elevational view. The striker pin 14 contacts, in this arrangement, the end 20 of the locking element 21 with the groove flank 22 facing away from the spring 18. During transport and assembly, the striker pin 14 is additionally retained by means of a safety locking pin 23 arranged at right angles thereto. After the installation at the smoke exhaust device or the like has been accomplished, the locking pin 23 is pulled out laterally by hand, so that the striker pin 14 is only held by the locking element 21.

The locking element 21 is disposed to be longitudinally displaced in a sensor housing 24 of, for example, steel, brass, or aluminum, which is laterally inserted, preferably threadedly inserted, in the striker pin housing 10. The longitudinal axis of the striker pin 14 and of the locking element 21 are disposed perpendicularly to each other. The other end 25 of the locking element 21 is thickened in the manner of a piston and presses under the force of the bias spring 26 against a blocking element 27 which, in turn, is in contact with the abutment 28. The abutment 28 is constructed as a moveable piston displaceable toward the locking element 21 and has an annular shoulder 29 on its outer surface. By means of the shoulder 29, the abutment 28 rests on a counter surface of the sensor housing 24 toward the side facing away from the blocking element 17. On the side of the abutment 28 facing away from the blocking element 27, a primer charge 30 is provided together with an electric primer, for example a conventional primer pellet with an incandescent wire. Ignition energy is fed to the primer charge 30 two electric leads 31. The sensor housing 24 is preferably transversely subdivided and connected by means of the screw connection 32 in the zone of the counter surface for the shoulder 29 of the abutment 28.

The blocking element 27 is constructed as an "ESTI" cartridge, extending with its neck-shaped extension 33 into a corresponding blind-hole-type recess 34 of the abutment 28. After the limit temperature for which the ESTI cartridge has been designed is exceeded, the glass ampoule is destroyed by the expansion of the fluid present therein. The glass fragments can fall out to a more or less complete extent through the lateral apertures 35 of the sensor housing 24 so that the locking element 21 can be shifted under the force of the spring 26 unimpeded in the direction toward the abutment 28, thus releasing the striker pin 14 which latter jumps toward the primer element 3 under the force of the spring 18 and, by the triggering of the primer element 3, effects the ignition of the pyrotechnical mixture of the compressed-gas cartridge.

The glass ampoule can also be selectively destroyed at temperatures below the predetermined limit temperature in an electrical manner in that primer element associated with the primer charge 30 is electrically triggered via leads 31 to cause the primer charge 30 to generate an amount of compressed gas sufficient to accelerate the abutment 28 toward the locking element 21 and thereby intentionally destroy the glass ampoule 27. The electrical primer element is preferably fashioned to be a conventional bridge primer with an internal resistance of preferably 1 to 2 ohms, actuatable by an electric current of about 0.8 ampheres and igniting, in turn, the conventional primer charge 30 producing a small amount of compressed gas, this primer charge being disposed behind the primer element. However, it is also possible to use, for example, one of the known gap or layer primer devices.

It is possible by the arrangement of the present invention, to obtain when used in a fire protection situation, an automatic triggering at a correspondingly elevated temperature, as well as to intentionally ignite, for example via smoke alarm mechanisms or manually controlled, compressed-gas cartridges which have not as yet been ignited. The electric triggering feature has the advantage that, by a so-called closed-circuit monitoring operation with a measuring current of, for instance, 10 milliamperes, the readiness of the electric parts of the system can be controlled.

FIG. 2 illustrates the connection of the compressed-gas unit 36 of the present invention having the laterally arranged sensor housing 24 with leads 31 with the servo cylinder for opening a skylight. As shown the unit 36 is disposed in the axial extension of the servo cylinder 6 having piston 7 and piston rod 8 directly effective on the skylight 38 so as to provide for opening movement about the bearing 37. The servo cylinder 6 is pivoted about the bearing 39 in the opening operation in response to activation of the compressed-gas generating unit with the position of the servo cylinder and the skylight 38 at the end of the opening operation being indicated in dashed lines. The edge of the roof bounding the skylight 38 is indicated generally by reference numeral 40. In this manner smoke exhaust openings are produced.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of appended claims.

We claim:

1. Apparatus for fire protection purposes comprising compressed-gas cartridge means having thermally responsive triggering means, said triggering means including striker means for forcibly being driven toward said compressed-gas cartridge means, locking means for maintaining said striker means at a spacing from said compressed-gas cartridge means, said locking means having a first end portion engaging a portion of said striker means for maintaining said striker means at the spaced position, first biasing means for biasing a second end portion of said locking means against a blocking means, said blocking means being disposed between said second end portion of said locking means and an abutment member, said blocking means being responsive to the exceeding of a predetermined temperature for enabling displacement of said locking means under the force of said first biasing means out of engagement with said striker means thereby permitting movement of said striker means toward said compressed-gas cartridge means.

2. Apparatus according to claim 1, wherein said striker means includes a striker pin member and second biasing means for biasing said striker pin member toward said compressed-gas cartridge means, said locking means including a locking element having said first end portion form-fittingly engaging a portion of said striker pin member.

3. Apparatus according to claim 2, wherein said locking element is laterally displaceable with respect to said striker pin member, and said blocking means being responsive to the exceeding of the predetermined temperature for one of moving from the blocking position and changing the shape thereof so as to permit lateral displacement of said locking element under the action of said first biasing means.

4. Apparatus according to claim 1, wherein said abutment member for said blocking means is disposed within a housing and includes a movable piston element displaceable within the housing in a direction toward said locking means for at least one of changing the shape of said blocking means and removing said blocking means from the blocking position, and further comprising electrically actuable primer means disposed on the side of the piston element facing away from said blocking means for producing compressed gas to cause displacement of said piston element toward said locking means.

5. Apparatus according to claim 4, wherein said electrically actuable primer means includes an electrically actuable primer element and a primer charge for producing compressed gas in response to actuation of said primer element.

6. Apparatus according to claim 4, wherein said piston element is provided with an annular shoulder at the outer surface thereof, said annular shoulder being supported on a counter surface of said housing in the direction toward said electrically actuable primer means.

7. Apparatus according to claim 1, wherein said blocking means is a container with a fluid filling for destroying the container upon exceeding the predetermined temperature.

8. Apparatus according to claim 1, further comprising servo-cylinder means having a piston chamber, and connection means for disposing said compressed-gas cartridge means along the axial extension of said servo-cylinder means, said connection means including means forming a communicating path between said compressed-gas cartridge means and said piston chamber of said servo-cylinder means.

9. Apparatus according to claim 8, wherein said communicating path means includes a reducing bore means, said compressed-gas cartridge means being responsive to the striking thereof by said striker means for generating compressed gas which travels through said reducing bore means to said piston chamber of said servo-cylinder means.

10. Apparatus according to claim 9, further comprising smoke exhaust means connected with said servo-cylinder means, said smoke exhaust means being movable from a closed to an open position in response to the generation of compressed gas by said compressed-gas cartridge means.

11. Apparatus according to claim 3, wherein said blocking means is a container with a fluid filling for destroying the container upon exceeding the predetermined temperature.

12. Apparatus according to claim 3, wherein said abutment member for said blocking means is disposed within a housing and includes a movable piston element displaceable within the housing in a direction toward said locking means for at least one of changing the shape of said blocking means and removing said blocking means from the blocking position, and further comprising electrically actuable primer means disposed on the side of the piston element facing away from said blocking means for producing compressed gas to cause displacement of said piston element toward said locking means.

13. Apparatus according to claim 12, wherein said electrically actuable primer means includes an electrically actuable primer element and a primer charge for producing compressed gas in response to actuation of said primer element.

14. Apparatus according to claim 12, wherein said piston element is provided with an annular shoulder at the outer surface thereof, said annular shoulder being supported on a counter surface of said housing in the direction toward said electrically actuable primer means.

15. Apparatus according to claim 14, wherein said blocking means is a container with a fluid filling for destroying the container upon exceeding the predetermined temperature.

16. Apparatus according to claim 14, further comprising servo-cylinder means having a piston chamber, and connection means for disposing said compressed-gas cartridge means along the axial extension of said servo-cylinder means, said connection means including means forming a communicating path between said compressed-gas cartridge means and said piston chamber of said servo-cylinder means.

17. Apparatus according to claim 16, wherein said communicating path means includes a reducing bore means, said compressed-gas cartridge means being responsive to the striking thereof by said striker means for generating compressed gas which travels through said reducing bore means to said piston chamber of said servo-cylinder means.

18. Apparatus according to claim 17, further comprising smoke exhaust means connected with said servo-cylinder means, said smoke exhaust means being movable from a closed to an open position in response to the generation of compressed gas by said compressed-gas cartridge means.

19. Apparatus according to claim 18, wherein said blocking means is a container with a fluid filling for destroying the container upon exceeding the predetermined temperature.

20. Apparatus for the thermal and electrical initiation of fire protection devices comprising a housing with a displaceable support member and an abutment means provided therein, blocking means being disposed between said displaceable support member and said abutment means, said displaceable support member being biased against said blocking means in the direction toward said abutment means, said blocking means being responsive to the exceeding of a predetermined temperature for enabling displacement of said displaceable support member for initiating a fire protection device, said abutment means being displaceable within said housing in the direction towards said displaceable support means, and an electrically actuatable gas-generating means being disposed on the side of the abutment means facing away from said blocking means for producing compressed gas to cause displacement of said abutment means toward said blocking means.

21. Apparatus according to claim 20, wherein said blocking means is responsive to displacement of said abutment means for at least one of changing the shape thereof and removal thereof from the blocking position so as to permit displacement of said displaceable support member in the direction toward said abutment means for initiating a fire protection device.

22. Apparatus according to claim 20, further comprising means disposed at one end of the housing for receiving the electrically actuatable gas-generating means therein, said end means being connected with said housing, said abutment means having an end portion facing away from the blocking means guided for movement within said end means.

23. Apparatus according to claim 22, wherein said end means and said housing are cylindrical members and said abutment means is a cylindrical member, said end means being threadedly secured to said cylindrical housing.

24. Apparatus according to claim 22, wherein said abutment means is provided with a cylindrical outer surface having an offset annular shoulder portion, said annular shoulder being supported on a counter surface of said end means in the direction toward said electrically actuatable gas-generating means.

25. Apparatus according to claim 22, wherein said abutment means is provided with a cylindrical outer surface having an offset annular shoulder portion, said end means being provided with an annular end face disposed within said housing, said annular shoulder of said abutment means being supported on said annular end face of said locking means in the direction toward said electrically actuatable gas-generating means.

26. Apparatus according to claim 22, wherein said electrically actuatable igniter means includes at least one electrical lead extending outwardly from said housing and said end means.

27. Apparatus according to claim 20, wherein said blocking means is a container with a fluid filling for destroying the container upon exceeding the predetermined temperature.

28. Apparatus according to claim 27, wherein said container is a glass vessel.

29. Apparatus according to claim 20, wherein said gas-generating means includes an electrically actuatable primer element and a primer charge for producing compressed gas in response to actuation of said primer element.

* * * * *